United States Patent [19]

Adkins

[11] Patent Number: 4,748,471

[45] Date of Patent: May 31, 1988

[54] DEVELOPMENT APPARATUS HAVING MEANS FOR RAPIDLY SHUTTING OFF THE FLOW OF DEVELOPER TO A MAGNETIC BRUSH

[75] Inventor: Kenneth D. Adkins, Rochester, N.Y.

[73] Assignee: Eastman Kodak Company, Rochester, N.Y.

[21] Appl. No.: 70,275

[22] Filed: Jul. 6, 1987

[51] Int. Cl.[4] ..... G03G 15/08

[52] U.S. Cl. ..... 355/3 DD; 355/14 D; 118/657

[58] Field of Search ..... 355/3 DD, 3 R, 14 D; 118/657

[56] References Cited

U.S. PATENT DOCUMENTS

| | | | |
|---|---|---|---|
| 3,523,518 | 8/1970 | Sage et al. | 118/653 X |
| 4,077,358 | 3/1978 | Kito | 118/658 |
| 4,373,798 | 2/1983 | Tsukada et al. | 355/3 DD |
| 4,422,405 | 12/1983 | Kasahara et al. | 118/658 |
| 4,538,896 | 9/1985 | Tajima et al. | 355/3 R |
| 4,602,862 | 7/1986 | Wyble | 355/3 DD |
| 4,647,180 | 3/1987 | Watanabe | 355/3 DD |
| 4,659,211 | 4/1987 | Oka | 355/14 D |
| 4,671,207 | 6/1987 | Hilbert | 118/657 |
| 4,682,874 | 7/1987 | Fantuzzo | 355/3 DD |
| 4,707,107 | 11/1987 | Joseph | 355/3 DD |

FOREIGN PATENT DOCUMENTS 0160830 3/1985 European Pat. Off. .

60-194476 10/1985 Japan .

OTHER PUBLICATIONS

RD-14362, "Magnetic Brush Development Apparatus", pp. 40-41 (Mar. 1976).

Xerox Disclosure Journal, "Rapid Cut-Off Development for Highlight Color", P. F. Morgan; vol. 12, No. 2, Mar./Apr. 1987.

Xerox Disclosure Journal, "Flexible Roll Shell", J. Zelazny; vol. 1, No. 9/10, Sep./Oct. 1976.

*Primary Examiner*—A. C. Prescott

*Attorney, Agent, or Firm*—G. Herman Childress

[57] ABSTRACT

In electrographic apparatus a magnetic brush development station has a housing with a sump for holding a supply of developer material, and a magnetic brush that applies developer material from the sump to a latent image on a photoconductor. A rotatable transport roller feeds developer material from the sump toward the magnetic brush. A cylindrical tube is positioned around the roller and spaced from it. The tube has two elongate, spaced slots, and the tube is rotatable between first and second positions. A shut-off member engages the tube adjacent one of the slots. When the tube is in one of its positions the shut-off member is at one side of the one slot and developer material from the sump can pass through the one slot to the magnetic brush. When the tube is in its second position the shut-off member blocks the flow of developer material to the magnetic brush.

4 Claims, 2 Drawing Sheets

DEVELOPMENT APPARATUS HAVING MEANS FOR RAPIDLY SHUTTING OFF THE FLOW OF DEVELOPER TO A MAGNETIC BRUSH

BACKGROUND OF THE INVENTION

The present invention relates to magnetic brush development apparatus for use with electrographic copiers/duplicators or the like and, more particularly, to improved apparatus for controlling the flow of developer material to the magnetic brush.

It is well known in the electrographic arts to use magnetic brush development apparatus for applying developer material to latent images n a photoconductor that is advanced past the magnetic brush. The developer material may initially be mixed in a sump to triboelectrically charge the material prior to delivering it to the developer roller of the magnetic brush apparatus.

It is also known to meter the flow of developer material to the magnetic brush and to gate or shut off the flow of material to the brush under certain circumstances. Metering of the developer material can be accomplished by a skive or by feeding the material through a slot leading to the magnetic brush. For example, in U.S. Pat. No. 4,538,896, toner is provided to a development station in a hopper. The hopper is closed by a plate that can be rotated to allow toner to fall through an opening in the hopper to a magnetic brush. Also, U.S. Pat. No. 3,523,518 discloses dispensing of toner from a cartridge having a series of holes therein by rotating the cartridge and allowing toner to fall through the holes in the cartridge under the influence of gravity.

It also is known to shut off the flow of developer material from a magnetic brush to a photoconductor in order to completely terminate the development of latent images on a photoconductor. For example, in color copiers having several magnetic brush development stations for applying toners of different colors to latent images it is known to move the stations relative to the photoconductor so that only one color toner at a time is applied to the photoconductor. Other ways of shutting off flow of developer material are known. See, for example, Japanese laid open patent publication No. 60-194476, published Oct. 2, 1985 and based on Japanese patent application No. 59-48060. The Japanese publication teaches the delivery of developer material from a sump to a magnetic brush for developing latent images by means of a transport roll located between the sump and the magnetic brush. The magnetic brush comprises a developer roll that is rotated in one direction to deliver developer material fromt he transport roll to the photoconductor. When it is desired to shut off the flow of developer material to the photoconductor, the developer roll is stopped and then rotated in the opposite direction so that a developer-free part of the developer roll faces the photoconductor to thereby stop application of developer to the photoconductor.

While the known prior apparatus may work satisfactorily, in some cases they may be difficult to operate as, for example, when the entire station is moved between operable and inoperable positions relative to the photoconductor. In addition, some of the prior apparatus may not provide the degree of reliability, rapid response time desired to control the flow of developer material to the magnetic brush, or complete termination of developer flow when desired.

The present invention is an improvement over commonly-assigned, copending U.S. patent application Ser. No. 944,895, filed Dec. 22, 1986 in the names of Frank Hacknauer et al and entitled "Magnetic Brush Development Apparatus Having a Gating and Metering Mechanism." The apparatus disclosed therein includes a roller for transporting developer material from a sump toward a magnetic brush, and a tube surrounding the roller and rotatable between two positions. The tube has two spaced slots that are aligned with the sump and brush when the tube is in one position so that developer material can travel from the sump to the roller through one slot and then through the other slot to the brush. When the tube is in its second position the tube slots are offset from the sump and brush to stop the flow of developer material to the brush. Thus the flow of developer material is controlled by rotating the tube a sufficient distance, e.g., 60% to offset the slots from the sump and magnetic brush. The tube may rotate a significant part of the way from its first to its second position before developer stops flowing to the magnetic brush. As a result, there may be a trailing edge of developer material that may be deposited in the interframe area between adjacent latent images on the photoconductor, and some material may even reach the latent image following the image that is to be developed, thus producing an undesirable leading edge effect on the following latent images. A more rapid shut-off of developer flow is desirable.

SUMMARY OF THE INVENTION

It is an object of the invention to provide development apparatus with improved means for rapidly shutting off the supply of developer material to a magnetic brush. Another object of the invention is to provide such apparatus which is relatively simple, easy and reliable to operate and which responds quickly. A further object is to provide a developer shut-off mechanism which requires little movement of parts before stopping or starting developer flow.

The present invention can be used with development apparatus for applying developer material to a latent image on a photoconductor. The apparatus has a housing with a sump for holding a supply of developer material, a magnetic brush for applying developer material to the latent image, and means for transporting developer material between the sump and the magnetic brush. A gating member is movable between first and second positions relative to the transporting means for controlling the flow of developer material to the magnetic brush. The gating member has an opening so that developer material can flow through the opening to the magnetic brush when the gating member is in its first position. The improvement comprises means for immediately shutting off the flow of developer material through the opening and to the magnetic brush when the gating member is moved from its first position toward its second position. The shut-off means comprises a member positioned closely adjacent the opening when the gating member is in its first position without interferring with the flow of developer material through the opening to the magnetic brush. The shut-off member is located with respect to the opening when the gating member is in its second position so that the member blocks the flow of developer material from the opening to the magnetic brush.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
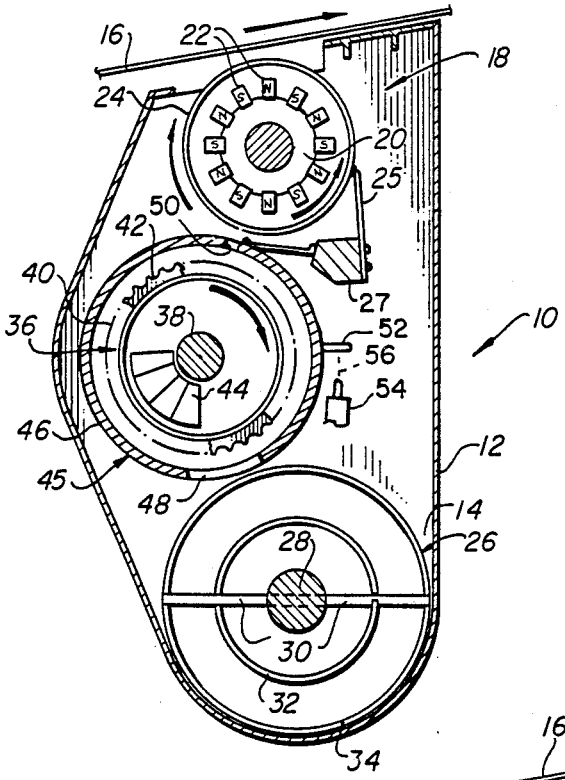
FIG. 1 is a fragmentary end view of a development apparatus incorporating the present invention with the parts positioned to allow transport of developer material from a sump to a magnetic brush.

Referring now to the drawings, a development station of an electrographic apparatus is generally designated 10 and comprises a housing 12 that defines a sump 14 for receiving developer material. A photoconductor 16 travels across the upper portion of the housing 12 in the direction shown by the arrow and contains on its lower surface one or more latent electrostatic images that are developed by developer material from sump 14. The developed images can be transferred to a copy sheet and fused thereto in a known manner or fused onto the photoconductor itself.

The development station 10 has a magnetic brush 18 for applying developer material to the images on photoconductor 16. The brush illustrated comprises a core 20 having a plurality of magnets 22 spaced around the core, and a cylindrical, non magnetic shell 24 that surrounds the core 20. The core and/or shell can be fixed or rotatable, as known int he art. As illustrated in the drawings, the core 20 is rotatable in a counterclockwise direction, and the shell rotates in a clockwise direction to thereby feed developer material in a clockwise direction to the photoconductor. A blade 25 supported from a bar 27 has a free-end that engages the shell 24 downstream of the development zone between the shell and photoconductor to remove unused developer material from the shell and return it to the sump.

Developer material in sump 14 can be mixed, agitated and triboelectrically charged by means of a ribbon blender generally designated 26. Blender 26 comprises a shaft 28 that is rotatable about its axis and has a plurality of rods 30 projecting therefrom. The rods carry inner and outer helical ribbons 32, 34. the pitch of the ribbon 32 is opposite from ribbon 34 so that when the shaft 28 is driven in a counterclockwise direction as shown in FIG. 1, ribbon 32 tends to drive developer material in one direction through the sump 14 while ribbon 34 tends to drive the material in the opposite direction. A ribbon blender is especially useful for mixing developer material having permanent magnetic carrier particles, such as disclosed in U.S. Pat. No. 4,546,060.

The electrographic apparatus as generally described hereinbefore is disclosed in more detail in European Patent Office Publication No. 160,830, published Nov. 13, 1985, which is based on U.S. patent application Ser. No. 597,323, filed Apr. 6, 1984. Reference is made to that publication for a more complete description of the apparatus.

Material from sump 14 is moved by the ribbon blender not only axially in the sump but also radially outwardly so that some of the material is provided to a feeding mechanism generally designated 36. The feeding mechanism is located between the top of the ribbon blender and the bottom of the magnetic brush. The feeding mechanism includes a shaft 38 that can be driven in a clockwise direction. A generally cylindrical transport roller 40 surrounds shaft 38 and is connected to it so that the roller is driven when the shaft is rotated. The outer surface of roller 40 is deeply fluted as shown at 42 to form a plurality of recesses and ridges that extend axially along the roller. The surface could also be grooved, or otherwise roughened or textured. The fluted surface picks up developer material from the lower quadrant of the gating member and transports it to the magnetic brush as described in more detail later. The roller can be made from any suitable material, such as extruded aluminum, plastic, etc.

Between the roller 40 and shaft 38 there is a stationary permanent magnet 44. The magnet is located beneath the shaft 38 and to the left thereof, and generally above and to the left of the ribbon blender 26. The magnet illustrated in the drawings extends through an arc of about 80 degrees. It is located so that developer material mixed by the ribbon blender is attracted to the outer surface of the roller 40 by the magnet 44 and held on the roller by the magnet as it is transported in a clockwise direction by the roller toward the magnetic brush. The position of the magnet, together with its arcuate dimension, assures that the material will be held onto the roller until it reaches a point where the material can be held onto the roller by the flutes 42 only. Developer material is then carried by the fluted surface through approximately 180 degrees or until it reaches approximately the right portion of the roller as viewed in FIG. 1 where it tends to be pulled from the fluted surface by gravity. Thus roller 40 helps to transport the developer material from the sump to a position where it can be attracted to the magnetic brush by the magnets 22 in the brush.

A gating and metering mechanism 45 includes a gating tube 46 which is positioned around the roller 40 and is spaced therefrom in order to provide an annular space for the flow of developer material between the roller and the tube 46. The tube is an elongate cylindrical member and can be made of plastic or other suitable materials. the tube is concentric with roller 40 and extends along the development station substantially the same distance as the magnetic brush 18. Tube 46 has an elongate, relatively wide slot 48 and a much narrower elongate slot 50. Both slots are generally rectangular in shape, and extend substantially the full length of brush 18 and tube 46. The width of each slot extends circumferentially along the tube so that each slot has two opposed longitudinally extending side edges. In the embodiment illustrated in the drawings, slots 48, 50 are approximately 205–210 degrees apart. The spacing of the slots depends, in part, on the location of the feeding mechanism 36 and gating mechanism 45 relative to the blender 26 and magnetic brush 18. The slots are spaced so that when the tube is in the position illustrated in FIG. 1 the wider slot 48 is substantially aligned with the bottom of roller 40 and between the magnet 44 and the ribbon blender. Also, when the tube is in the FIG. 1 position the slot 50 extends along the portion of tube 46 that is nearest to the shell 24 of the magnetic brush 18.

Slot 48 is relatively wide so that a substantial amount of developer material from sump 14 can pass through slot 48 and enter the space between tube 46 and roller 40 to be transported by roller 40 to slot 50. Slot 50, on the other hand, is much narrower and meters the desired amount of developer material to the magnetic brush. The slots may have various dimensions, depending upon a number of factors. By way of example, slot 48 can be approximately 0.05 inch wide and slot 50 can be approximately 0.045 inch wide. These dimensions can provide a developer flow rate of apprximately 3.2 grams per inch per second to the magnetic brush.

Figure 2:
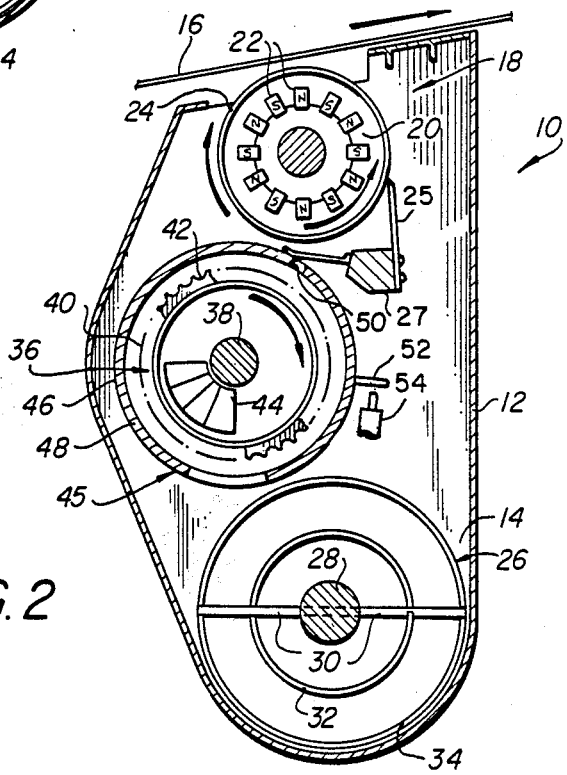
FIG. 2 is a view similar to FIG. 1 but showing the parts in a second position blocking the flow of developer material to the brush.

Tube 46 is oscillated between the positions shown in FIG. 1 and FIG. 2 to control the flow of developer material to the magnetic brush. Such movement can be accomplished in any suitable manner. For example, a pin 52 secured to the tube 46 can be coupled to a solenoid 54, as shown diagrammatically at 56, so that the solenoid is effective to move the tube between its two positions. The solenoid can be controlled from the logic and control unit of the associated electrographic apparatus so that it is actuated at precisely the correct time relative to the movement of images on the photoconductor past the development station.

Means generally designated 60 are provided to immediately shut off the flow of developer material to magnetic brush 18 through slot 50 when the tube 46 is rotated. The shut-off means 60 illustrated comprises an elongate plate 62 having one end portion **62*a* secured to bar 27. The other end portion 62*b* of plate 62 is in sliding contact with the outer surface of tube 46 closely adjacent to the right longitudinal side edge of slot 50 when the tube is in the position shown in FIGS. 1 and 3. End portion 62*b* preferably is curved so the free end of the plate is elevated slightly from the surface of the tube to avoid "stubbing" of the end of the plate in slot 50 as the tube is rotated from its FIGS. 1 and 3 position to its FIGS. 2 and 4 position. Preferably the plate is thin and flexible, and is flexed when mounted on the bar and resting on tube 46. Because of this construction and mounting, end portion 62*b* bears against the surface of the tube and maintains sliding contact with the tube. The pressure exerted by the plate against the tube effectively seals the interface therebetween and avoids passage of developer material between the plate and tube. The plate extend the full length of slot 50 so that the plate covers the slot and blocks the flow of developer material from slot 50 to the magnetic brush 18 when tube 46 is rotated a few degrees from its position illustrated in FIGS. 1 and 3 to its position illustrated in FIGS. 2 and 4. Preferably the plate is made of brass or other suitable low friction material so that the plate does not significantly increase the torque required to rotate the tube 46**.

Figure 3:
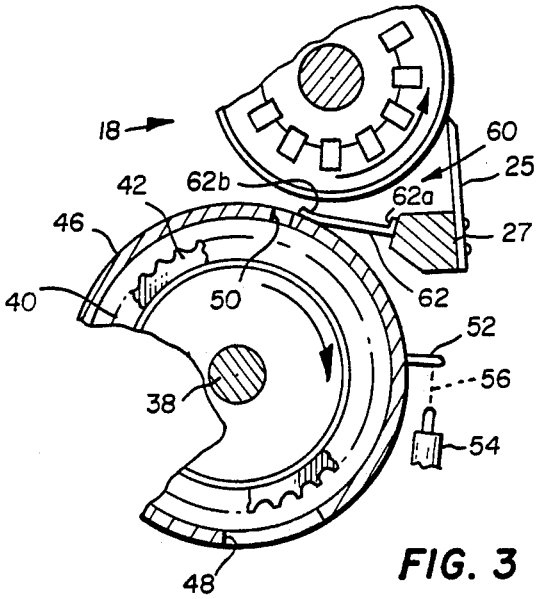
FIGS. 3 and 4 are enlarged fragmentary views of portions of the apparatus shown in FIGS. 1 and 2, respectively.

When the tube is in the position shown in FIGS. 1 and 3 slot 48 is between the ribbon blender and the magnet 44 so that developer material from the sump can be driven by the ribbon blender through the slot. Such material is attracted to roller 40 by the magnet 44. Roller 40 transports the material to the top of the roller where it is attracted toward the magnetic brush 18 by magnets 22 in the core of the magnetic brush. Thus some of the developer material will flow through the smaller slot 50 to the magnetic brush without interference from plate 62.

Figure 4:
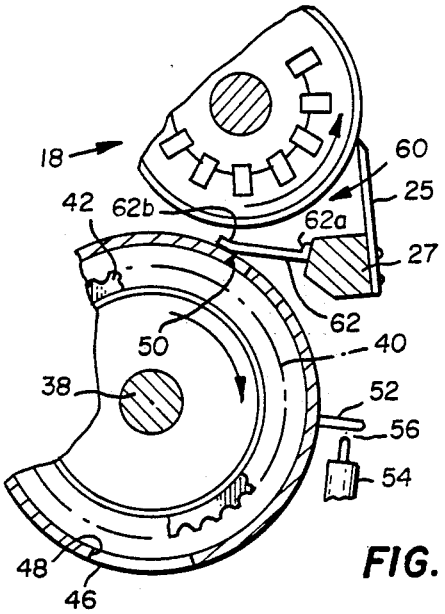

In order to shut off the flow of developer material to the magnetic brush, the tube is rotated a few degrees clockwise, for example approximately 5 degrees, from its FIGS. 1 and 3 position to its FIGS. 2 and 4 position. As this rotation occurs, the slot 50 passes under plate portion **62*b*, and portion 62*b* then contacts the tube 46 adjacent the left longitudinal side edge of the slot. This slight movement immediately shuts off the flow of developer material to magnetic brush 18 through slot 50. Developer material flowing through slot 50 then travels along the bottom surface of plate 62 or along tube 46 until gravity returns the material to sump 14. The pressure contact between plate end portion 62*b* and tube 46 prevents flow of developer material therebetween to the brush 18. At this time the larger slot 48 is located relative to the ribbon blender and the sump so that material from the ribbon blender and sump can continue to pass through the slot 48 into the space between the tube 46 and roller 40 and be discharged through slot 50 back into the sump. Thus the space between tube 46 and roller 40 remains full of developer material. This permits the flow of material to brush 18 to be restarted quickly when tube 46 is returned to the position shown in FIGS. 1 and 3**.

Movement of the tube 46 between its two positions can be effected very rapidly due to the short distance required to move the tube. Also, the space between tube 46 and roller 40 remains substantially full of developer material even when the tube is in the position shown in FIGS. 2 and 4. This makes it possible to quickly and reliably start, as well as stop, the flow of developer material to the magnetic brush. This is especially desirable when the apparatus is used in copiers where two or more similar development stations are used, each with developer material having different colored toners that are to be applied to adjacent images on the photoconductor and wherein the adjacent images are separated by a small "interframe" distance of about 1.5 inches, for example. In this situation the flow of one color developer material to the photoconductor must be stopped and started quickly and with great accuracy in order to avoid contamination of an adjacent image on the photoconductor. More specifically, in the absence of shut-off means 60, the tube 46 may be need to be rotated 40–60 degrees to completely stop the flow of developer material to the magnetic brush. This can produce a trailing edge of developer material from one development station that is longer than the interframe area between two images on the photoconductor. Such results in the trailing edge of developer material being applied to the leading edge of the next image on the photoconductor, thereby contaminating the next image.

The invention has been described in detail with particular reference to a preferred embodiment thereof, but it will be understood that variations and modifications can be effected within the spirit and scope of the invention as described hereinbefore and as defined in the appended claims.

I claim:

1. In a development apparatus for applying developer material to a latent image on a photoconductor, the apparatus having a housing with a sump for holding a supply of developer material, a magnetic brush for applying developer material to the latent image, means for transporting developer material between the sump and the magnetic brush, a gating member movable between first and second positions relative to the transporting means for controlling the flow of developer material to the magnetic brush, the gating member having an opening so that developer material can flow through the opening to the magnetic brush when the gating member is in its first position, the improvement comprising:

means for immediately shutting off the flow of developer material through the opening and to the magnetic brush when the gating member is moved from its first position toward its second position, the shut-off means comprising a member closely adjacent the opening when the gating member is in its first position without interfering with the flow of developer material through the opening to the magnetic brush, and the shut-off member being located with respect to the opening when the gating member is in its second position so that the member blocks the flow of developer material from the opening to the magnetic brush.

2. The improvement as set forth in claim 1 wherein the shut-off member comprises an elongate flexible plate having a portion in sliding contact with the gating member adjacent one side of the opening when the gating member is in its first position and adjacent the other side of the opening when the gating member is in its second position, and means mounting the plate so that it is flexed when in contact with the gating member to substantially seal the interface therebetween and avoid passage of developer material between said portion of the plate and the gating member.

3. The improvement as set forth in claim 2 wherein the portion of the plate in contact with the gating member is curved and the end of the plate adjacent the curved portion is elevated from the surface of the gating member to avoid stubbing of the end of the plate in the opening in the gating member.

4. In a magnetic brush development apparatus for applying developr material to a latent image on a photoconductor, the apparatus having a housing with a sump for holding a supply of developer material, a magnetic brush for applying developer material to the latent image, a rotatable transport roller between the sump and the magnetic brush, a magnet in the roller for attracting developer material from the sump to the roller, a gating and metering mechanism for controlling the flow of developer material to the magnetic brush, the mechanism comprising a gating member positioned around at least part of the transport roller, the gating member having a first opening having two opposed side edges so that developer material can flow through the opening to the magnetic brush, the gating member having a second opening spaced from the first opening through which developer material can flow from the sump to the roller, and means for moving the gating member between first and second positions, the improvement comprising:

means for immediately shutting off the flow of developer material through the first opening when the gating member is rotated from its first position toward its second position, the shut-off means comprising a member having a first portion in sliding contact with the gating member closely adjacent one side edge of the first opening when the gating member is in its first position without interferring with the flow of developer material through the first opening to the magnetic brush, and the first portion of the shut-off member being in contact with the gating member closely adjacent the other side edge of the first opening when the gating member is in its second position so that the member blocks the flow of developer material from the first opening to the magnetic brush.

* * * * *